United States Patent [19]

Dean

[11] 4,058,951

[45] Nov. 22, 1977

[54] FRAMES FOR BUILDINGS

[76] Inventor: Rudy Dean, 560 Hawthorn Road, Caulfield South, Victoria 3162, Australia

[21] Appl. No.: 688,549

[22] Filed: May 21, 1976

[51] Int. Cl.[2] ..... E04C 2/38; E06B 1/04

[52] U.S. Cl. ..... 52/656; 49/504

[58] Field of Search ..... 52/656, 664, 79, 243, 52/633, 657, 658, 626, 624; 49/504

[56] References Cited

U.S. PATENT DOCUMENTS

| | | | |
|---|---|---|---|
| 2,097,484 | 11/1937 | Winslow | 52/656 X |
| 3,363,371 | 1/1968 | Villalobos | 52/656 X |
| 3,487,602 | 1/1970 | Braun et al. | 52/656 X |

*Primary Examiner*—J. Karl Bell

*Attorney, Agent, or Firm*—Cushman, Darby & Cushman

[57] ABSTRACT

A rectangular frame for a building in which the peripheral members are all formed from sheet material with the same cross section and consist of two open channels of rectangular cross section extending parallel side by side facing the same way with the adjacent edges of the channels joined together by a flat web. Slots are formed in the flat web at regular intervals along the junctions of the web with the channels, the slots on one side of the web being staggered with respect to those on the other side.

2 Claims, 6 Drawing Figures

FRAMES FOR BUILDINGS

It is customary to construct the frames of buildings from members which are shaped sections of steel, aluminum, or other metal, in substitution for timber which is becoming scarce and expensive. The shaped metal sections presently used have the disadvantages that a number of different sections are required in the one frame, that conventional accessories cannot be used with them, and that the assembly of the members into frames is a time-consuming operation, requiring precision and skill.

It is the principal object of the present invention to provide a frame for a building composed entirely of members of the one cross section which can be readily assembled into frames.

In order to achieve the above-mentioned principal object, the present invention provides, for a building, a rectangular frame of which the peripheral members are formed from sheet material and consist of two open channels of rectangular cross section extending parallel side by side facing the same way with the adjacent edges of the channels joined together by a flat web.

The word "building" is intended to include houses, factories, sheds, crates, and all structures traditionally comprising a timber frame to which cladding is affixed.

The members are preferably formed by cold forming sheet metal. They may also, for example, be formed by extruding plastics.

One practical example of a frame according to the present invention will now be described with reference to the accompanying drawings. In these drawings.

Figure 1:
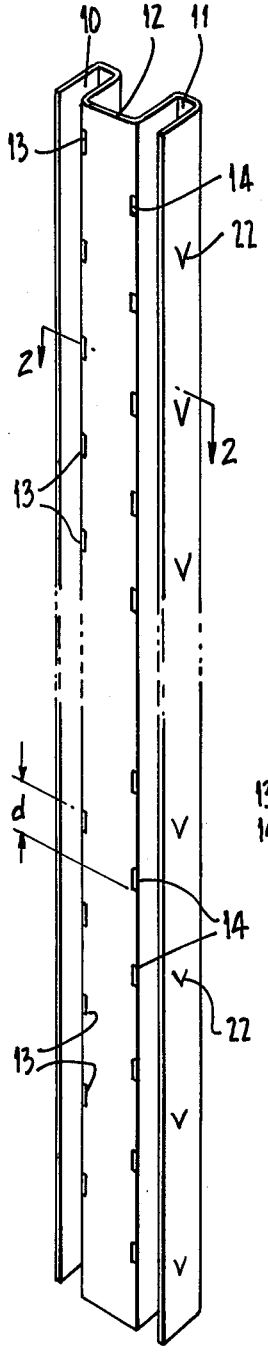
FIG. 1 is a perspective view of a frame member.

Referring now to the drawings, the members are formed in lengths from sheet metal and consist of two parallel open channels 10 and 11 facing the same way and joined together at adjacent edges by a flat web 12. The overall width of the members is 8 cm and the depth is 35 mm.

Slots 13 are formed at uniform intervals, e.g. 10 cm intervals, along one side of the web 12 at the junction with the channel 10, and similar slots 14 are formed at the same intervals along the other side of the web 12 at the junction with the channel 11. The slots 13 are not transversely opposite the slots 14, but are staggered in relation thereto by such an amount that the longitudinal distance between the remote ends of corresponding slots, i.e. the distance 'd' in FIG. 1, is equal to the depth of the channels 10 and 11; e.g. if the channels are 35 mm deep, the slots may be 11 mm, leaving a transverse strip of web 12 13 mm wide attached at both ends to the channels. The slots 13 and 14 are slightly wider than the thickness of the material from which the members are made; e.g. if the members are formed from metal 1 mm thick, the slots may be 2 mm wide, so that a strip of the metal can slide easily through the slots but cannot be significantly rotated in the slots.

The members may be formed inlong lengths, and cut to the required size before use.

Figure 3:
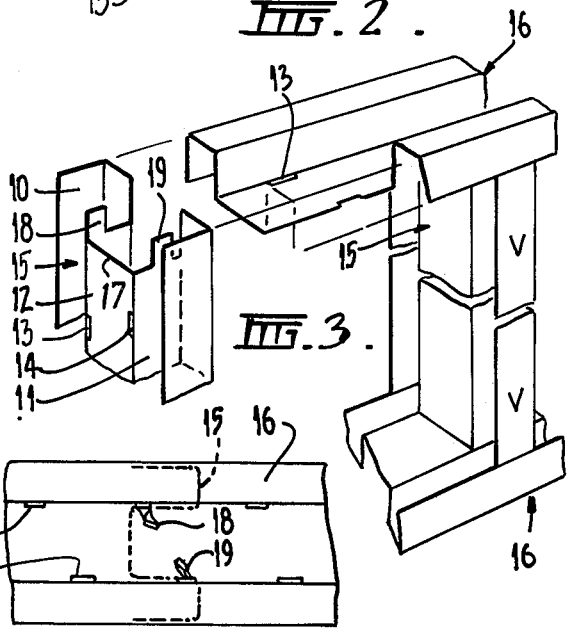
FIG. 3 is a perspective view of portion of the frame and of two members prepared for joining at right angles.
Figure 4:
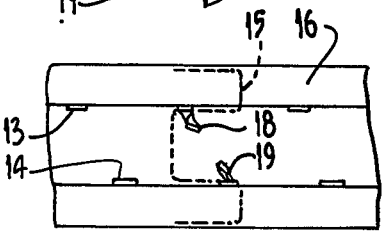
FIG. 4 is a plan of a right angled joint.

In assembling a frame from the members, the studs 15 and plates 16, as shown in FIG. 3, are joined by shaping the ends of the studs 15 to fit neatly around the plates 16, as shown at 17. The channels 10 and 11 project beyond the web 12 by such an amount that the end of the web 12 and the sides and end of each channel all engage the surface of the plate 16. At each end of the stud 15, the inner side of the channel 10 is cut away to form at the junction with the web 12 a rectangular tongue 18 of a size to fit neatly and easily through the slots 13. Similarly, the inner side of the channel 11 is cut away to form at the base of the channel a similar tongue 19.

Figure 2:
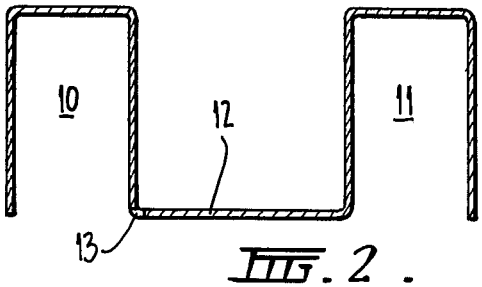
FIG. 2 is a cross section on the line 2—2 of FIG. 1.

The frame is assembled by placing the studs 15 at right angles to the plate 16 with the tongue 18 projecting through the slot 13 and the tongue 19 projecting through the slot 14. The projecting portions of the tongues are then bent inwardly and rotated by twisting to lock the stud and plate together. Because the tongues 18 and 19 are located at diagonally opposite corners of the open rectangle outlined in plan as shown in FIG. 2 by the inner sides of the channels 10 and 11 and the web 12, and because the cutout portion 17 of the web 12 is held firmly against the web 12 of the plate 16, the joint so made is extremely rigid.

Figure 5:
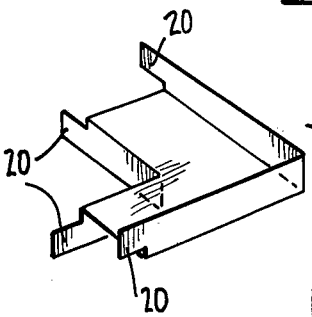
FIG. 5 is a perspective view of a linking member.

When it is desired to assemble two frames at right angles to form the corner of a building, this may be achieved by passing a metal strip through corresponding slots in the corner studs, and twisting the projecting ends to lock the studs together. As a possible alternative, linking members of the construction shown in FIG. 5 may be employed. In use, tongues 20 are twisted after passing through the slots 13 and 14.

Figure 6:
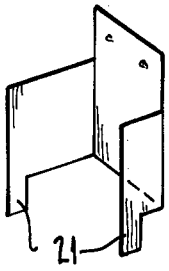
FIG. 6 is a perspective view of a different form of linking member.

If it is desired to attach timber beams or other components to the frame, this may be achieved by linking members such as the brackets shown in FIG. 6. These brackets are attached to the components by nails, screws or the like, and the tongues 21 are inserted through the slots 13 and 14 in the frame members and twisted to lock the components to the frame.

Intersecting slots formed in the outside walls of the channels 10 and 11 define V-shaped tongues 22 which can be bent outwardly to constitute spikes on which plaster sheets, wall board or other cladding may be forced, and retained by clinching the spikes.

As the members are approximately the size of conventional timber beams, fittings designed for use with timber buildings are suitable for use with buildings comprising frames according to this invention.

I claim:

1. For a building, a rectangular frame of which the peripheral members are formed from sheet material and consist of two identical open channels of rectangular cross section extending parallel side by side facing the same way with the adjacent edges of the channels joined together by a flat web having formed in it at regular intervals along its junctions with the channels slots of length less than half the depth of the channels, the slots formed in one side of the web being longitudinally displaced with respect to the slots formed in the other side of the web and the greatest longitudinal distance between an end of a slot and the end of the closest slot on the other side of the web being equal to the depth of the channels.

2. A building structure comprising a rectangular frame of which the peripheral members are formed from sheet material and consist of two identical open channels of rectangular cross section extending parallel side by side facing the same way with the adjacent edges of the channels joined together by a flat web having formed in it at regular intervals along its junctions with the channels slots of length less than half the depth of the channels, the slots formed in one side of the web being longitudinally displaced with respect to the slots formed in the other side of the web and the greatest longitudinal distance between an end of a slot and the end of the closest slot on the other side of the web being equal to the depth of the channels.

* * * * *